US008667646B2

(12) United States Patent
Krajewski et al.

(10) Patent No.: US 8,667,646 B2
(45) Date of Patent: Mar. 11, 2014

(54) MAGNETIC BUMPER APPARATUS FOR VEHICLE CLOSURE

(75) Inventors: Paul E. Krajewski, Troy, MI (US); Matthew J. Nelson, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/408,164

(22) Filed: Feb. 29, 2012

(65) Prior Publication Data

US 2013/0219658 A1 Aug. 29, 2013

(51) Int. Cl.
*E05F 5/02* (2006.01)

(52) U.S. Cl.
USPC ..... 16/82; 16/86 R; 16/86 A

(58) Field of Classification Search
USPC ..... 16/82–86 C
See application file for complete search history.

(56) References Cited

U.S. PATENT DOCUMENTS 5,392,881 A * 2/1995 Cho et al. ..... 188/267
5,632,361 A * 5/1997 Wulff et al. ..... 188/267
5,971,451 A * 10/1999 Huang ..... 293/102
6,167,589 B1 * 1/2001 Luedtke ..... 16/71
6,394,239 B1 * 5/2002 Carlson ..... 188/267.2
7,121,980 B2 * 10/2006 Chen ..... 482/1
2008/0272621 A1 * 11/2008 Racine ..... 296/207

* cited by examiner

*Primary Examiner* — Victor Batson
*Assistant Examiner* — Matthew Sullivan
(74) *Attorney, Agent, or Firm* — Quinn Law Group, PLLC

(57) ABSTRACT

A magnetic bumper apparatus for constraining a vehicle closure to a vehicle closure interface includes first and second magnetic members configured for attachment to the closure and closure interface, and a non-magnetic bumper element interposed therebetween. Each magnetic member defines a plurality of spatially modulated magnetic fields (SMMF) in corresponding patterns to provide a cumulative SMMF attractive force and a cumulative SMMF repulsive force between the magnetic members and define a separation reference and an alignment reference. The magnetic members in magnetic proximity to each other constrain the closure to the closure interface with respect to the alignment and separation references to prevent contact between a closure surface and a closure interface surface and to define at least one alignment parameter therebetween. Constraining the closure to the closure interface may include resisting a non-magnetic force inputted to the vehicle to prevent contact between the closure and closure interface surfaces.

20 Claims, 2 Drawing Sheets

MAGNETIC BUMPER APPARATUS FOR VEHICLE CLOSURE

TECHNICAL FIELD

The present invention relates to a magnetic bumper apparatus for a vehicle closure.

BACKGROUND

Overslam bumpers, bumper wedges, and other cushioning contact apparatus are used in vehicle closure systems to counteract over travel of vehicle closures during closing to prevent contact between the closure, for example, a liftgate, and the portion of the vehicle receiving the closure, for example, the liftgate opening. One or both of the liftgate and liftgate opening may include an appearance surface, a fascia, trim, a lamp or other components which may be damaged or degraded by unintended contact during closing of the liftgate, or when the vehicle is subjected to other forces causing movement of the closure in contact with the closure interface, such as undamped or excessive vibration, road input, or other misaligning forces. Contact damage may include coating and surface abrasion, paint chipping, etc. of the interfacing surfaces.

Bumper, wedge or other systems which rely on contact to limit and/or cushion a closure during a closing event may wear, rub and/or abrade at the contacting surfaces, or may squeak, rattle, age, lose cushioning capacity, or otherwise deteriorate during vehicle operation. As the contact bumper wears, the alignment of the closure to the closure interface may deteriorate such that clearance gaps and surface offsets may change, negatively affecting vehicle appearance, fit, finish and closure opening and closing efforts. Due to dimensional variation of the bumper components and the vehicle during build and over the time of vehicle operation, bumper and other contact type bumper systems may be difficult to install and maintain, often generating fit, noise, and wear issues.

SUMMARY

A magnetic bumper apparatus for a vehicle closure is provided. The magnetic bumper apparatus may be configured as a non-contact bumper for use with a vehicle including a closure movably attached to the vehicle and configured for opening and closing with respect to a closure interface defined by the vehicle and configured to receive the closure. As described herein, the non-contact magnetic bumper may be advantaged by constraining the closure with respect to the vehicle closure interface to prevent contact between adjacent surfaces, and to provide a repelling force during closing events sufficient to prevent over travel of the closure. The non-contact configuration of the magnetic bumper apparatus precludes noise and wear. In one example, the bumper apparatus is adjustable such that the apparatus may be repositioned to compensate for vehicle changes over time, which may include changes in closure alignment due to vehicle repair, vehicle component wear or distortion, or other external factors such as vibration and road force input which may affect the alignment and fit of the closure to the closure interface. A non-magnetic bumper may be interposed between the magnetic members of the bumper to prevent contact between the magnetic members, preventing wear, misalignment, noise or other contact-attributable conditions.

The magnetic bumper apparatus includes a first magnetic member configured for attachment to one of the vehicle closure and the vehicle closure interface and a second magnetic member configured for attachment to the other of the vehicle closure and the vehicle closure interface, wherein the magnetic bumper apparatus is configured to constrain the closure with respect to the vehicle closure interface when the first and second magnetic members are in magnetic proximity of each other.

The first magnetic member defines a first plurality of spatially modulated magnetic field (SMMF) producing elements in a first pattern, and the second magnetic member defines a second plurality of spatially modulated magnetic field (SMMF) producing elements in a second pattern. The first and second patterns are arranged such that each one of the first plurality of SMMF producing elements corresponds to a respective one of the second plurality of SMMF producing elements to form a corresponding pair of SMMF producing elements, the first and second patterns defining a plurality of corresponding pairs of SMMF producing elements. At least one of the plurality of corresponding pairs of SMMF producing elements are magnetically attractive and at least one of the plurality of corresponding pairs of SMMF producing elements are magnetically repulsive, such that the first magnetic member and the second magnetic member in magnetic proximity to each other are configured to provide a cumulative SMMF attractive force and a cumulative SMMF repulsive force defined by the plurality of corresponding pairs of SMMF producing elements.

The first and second magnetic members in magnetic proximity to each other define a separation reference and an alignment reference determined by the plurality of corresponding pairs of SMMF producing elements, such that the first magnetic member, when attached to one of the vehicle closure and the vehicle closure interface and the second magnetic member, when attached to the other of the vehicle closure and vehicle closure interface and in magnetic proximity to the first magnetic member, constrain the vehicle closure to the vehicle closure interface with respect to the separation reference and the alignment reference. Constraining the vehicle closure to the vehicle closure interface may define at least one alignment parameter between a vehicle closure surface and a vehicle closure interface surface, and may prevent contact between the vehicle closure surface and the vehicle closure interface surface. The alignment parameter may be a clearance gap or an offset between the vehicle closure and the vehicle closure interface. Constraining the closure to the closure interface may include resisting or opposing a non-magnetic force inputted to the vehicle, to prevent contact between a closure surface and a closure interface surface. The first and/or second magnetic members may be adjustable, such that at least one of the separation reference and the alignment reference may be adjusted with respect to a datum, which may be a datum defined by the vehicle.

A bumper element may be interposed between the first and second magnetic members and may be attached to one of the first and second magnetic members such that the bumper element is not in contact with one of the first and second magnetic members when the first and second magnetic members are in magnetic proximity and in magnetic equilibrium. The bumper element may be non-magnetic and configured to prevent contact between the first and second magnetic members and between the closure surface and the closure interface surface when the first and second magnetic members are in magnetic proximity and magnetic non-equilibrium, which may be, for example, when a magnetic bumper apparatus is responding to and/or opposing an excessive force inputted to the vehicle. The force inputted to the vehicle may be sufficiently excessive such that the repulsive force is sufficiently overcome to put the first and second magnetic members in magnetic non-equilibrium, as may occur during vehicle assembly or overtravel or slamming of the closure relative to the closure interface.

A method for constraining a vehicle closure relative to a vehicle closure interface is provided. In one example, the vehicle closure may be configured as a liftgate movably attached to a vehicle and configured to open and close with respect to a liftgate opening defined by the vehicle. The method includes providing a magnetic bumper apparatus including a first magnetic member and a second magnetic member, wherein the magnetic bumper apparatus is configured as described herein, such that the first magnetic member and the second magnetic member in magnetic proximity to each other are configured to provide a cumulative SMMF attractive force and a cumulative SMMF repulsive force. The cumulative SMMF attractive force and the cumulative SMMF repulsive force define a separation reference, an alignment reference, and an equilibrium distance relative to the first and second magnetic member such that at magnetic equilibrium the first and second magnetic members are not in contact and are separated by the equilibrium distance.

The bumper apparatus may include a non-magnetic bumper element, which may be operatively attached to one of the first and second magnetic members. The method includes operatively attaching the first magnetic member to one of the closure and the closure interface, operatively attaching the second magnetic member to the other of the closure and the closure interface, wherein the second magnetic member is positioned relative to the first magnetic member to provide a plurality of corresponding pairs of SMMF producing elements. The method further includes aligning the separation reference and the alignment reference of the apparatus with respect to at least one datum defined by the vehicle, and constraining the closure to the closure interface when the first magnetic member and the second magnetic member are in magnetic proximity to each other, wherein constraining the closure to the closure interface provides at least one of a clearance gap and an offset between the closure and the closure interface. At least one of the first and second magnetic members may be adjustable in position with respect to one of the closure and closure interface, such that aligning the separation reference or alignment reference with respect to the datum may include adjusting the position of at least one of the first and second magnetic members.

The method may include resisting a force input to one of the closure and the closure interface by maintaining magnetic equilibrium between the first magnetic member and the second magnetic member such that contact between the closure and the closure interface resultant from the force is minimized. The method may further include engaging the bumper element with the first and second magnetic members to prevent contact between a closure surface and a closure interface surface.

The above features and other features and advantages of the present invention are readily apparent from the following detailed description of the best modes for carrying out the invention when taken in connection with the accompanying drawings.

DETAILED DESCRIPTION

Figure 1:
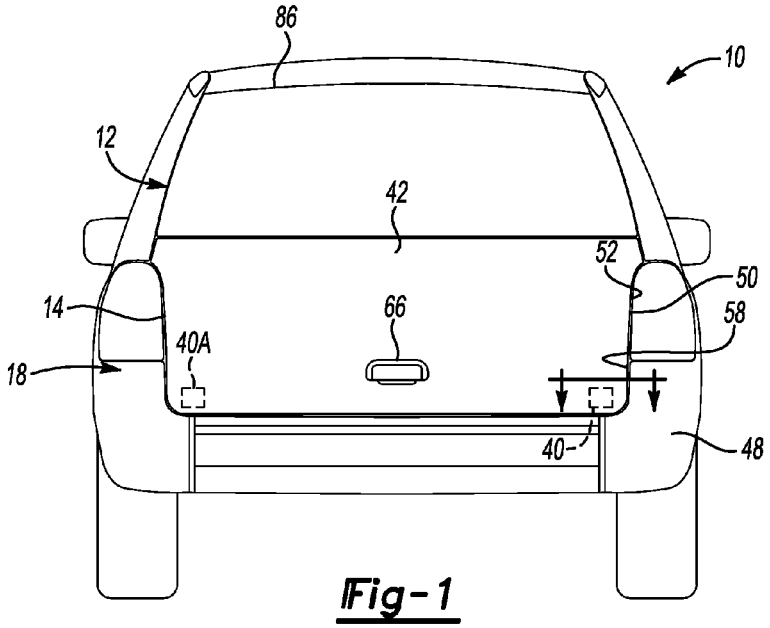
FIG. 1 is a schematic rear view of a vehicle including a closure, a closure interface, and a magnetic bumper apparatus configured to constrain the closure to the closure interface.

Referring to the drawings wherein like reference numbers represent like components throughout the several figures, the elements shown in FIGS. 1-4 are not necessarily to scale or proportion. Accordingly, the particular dimensions and applications provided in the drawings presented herein are not to be considered limiting. FIG. 1 shows a vehicle generally indicated at 10. The vehicle 10 includes at least one closure 12 movably attached to the vehicle 10 configured to selectively close a closure interface 18. The closure interface 18 is defined by the vehicle 10 and is configured to receive the closure 12. The closure 12 may be configured as a liftgate, as shown in FIG. 1 in a non-limiting example. The closure 12 may be configured as a tailgate, a trunk lid, a deck lid, a hood or bonnet, a cargo door, and a passenger door configured to selectively close a respective closure interface 18.

The closure 12 may be movably attached to the vehicle 10 by an attachment 86, which may include, for example, one or more hinges, supports, struts, etc. to movably attach the closure 12 to the vehicle 10 such that the closure 12 may be closed during a closing event and opened during an opening event with respect to the closure interface 18. A latching mechanism 66 may be used to open or close the closure 12, and/or to latch the closure 12 to the vehicle 10, for example, by engaging a latching pawl (not shown) of the latching mechanism 66 and a striker (not shown), where the striker is incorporated into or operatively attached to the closure interface 18. In one example, the striker may be configured as a D-ring with which the latching mechanism 66 engages.

Figure 2:
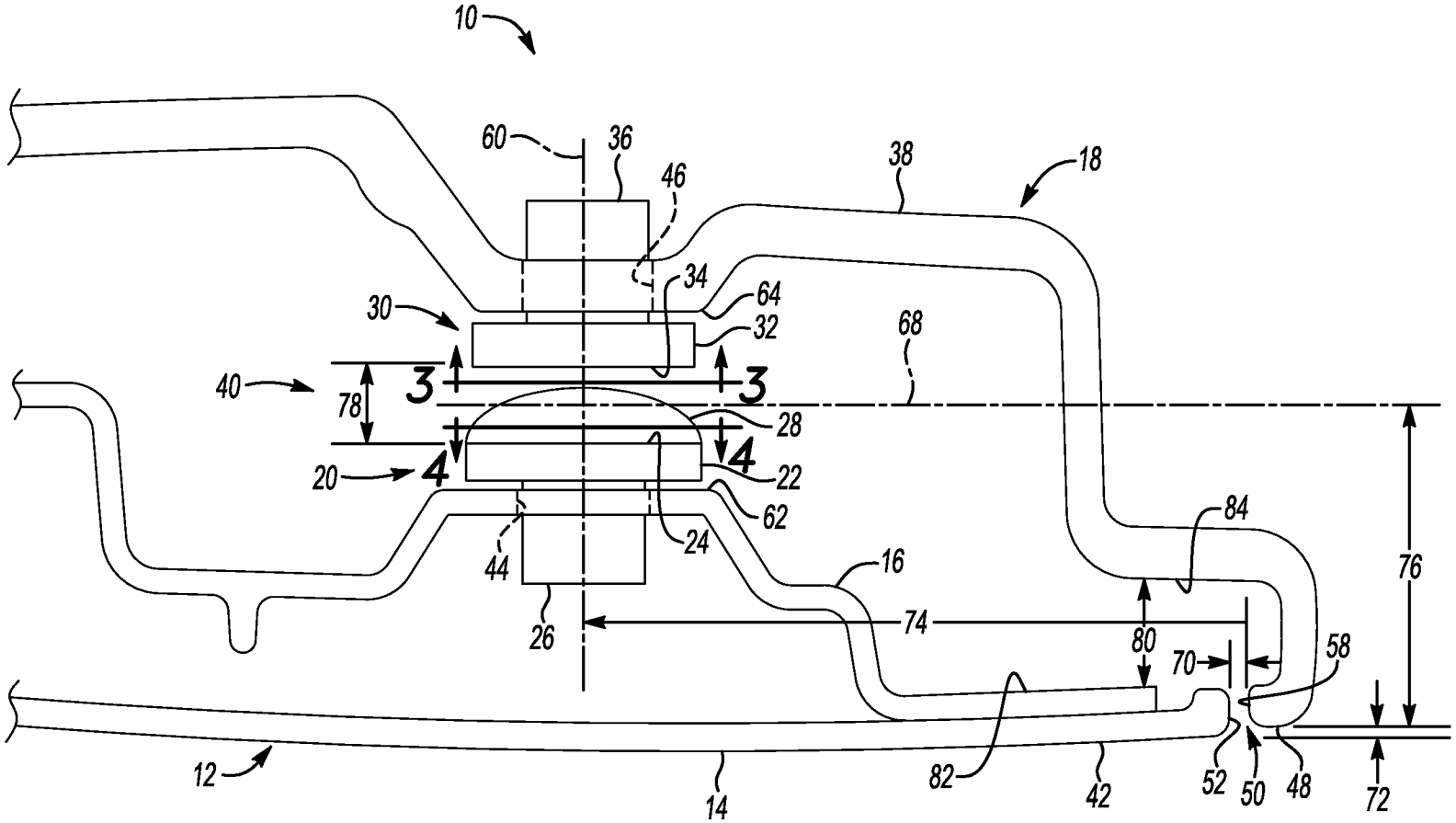
FIG. 2 is a schematic top view of section 2-2 of FIG. 1 showing the magnetic bumper apparatus in an installed position with respect to the vehicle closure and closure interface.

At least one closure bumper apparatus 40 is provided to prevent contact between interfacing and/or adjacent surfaces of the closure 12 and the closure interface 18, such as adjacent surfaces 52, 58, during a closing event and/or during vehicle operation, e.g., the bumper apparatus 40 is configured as a non-contact apparatus. As shown in FIG. 2 and described in further detail herein, the bumper apparatus 40 is a magnetic bumper including first and second magnetic members 20, 30. The first magnetic member 20 includes a plurality of spatially modulated magnetic field (SMMF) producing elements generally indicated at 54 in FIG. 4 and arranged in a first pattern 24. The second magnetic member 30 includes a plurality of spatially modulated magnetic field (SMMF) producing elements generally indicated at 56 in FIG. 5 and arranged in a second pattern 34, where the second pattern 34 is configured to correspond with the first pattern 24 to define a plurality of corresponding pairs of spatially modulated magnetic field (SMMF) producing elements 54*a*, 56*a* . . . 54*n*, 56*n*. The plurality of corresponding pairs of SMMF producing elements 54*a*, 56*a* . . . 54*n*, 56*n* are configured to maintain an equilibrium distance 78 between the interfacing magnetic patterns 24, 34 of the first and second magnetic members 20, 30, and to align the first and second magnetic members 20, 30 to each other, wherein the apparatus 40 is positioned in the vehicle 10 to prevent contact between the closure 12 and the closure interface 18 and define one or more closure alignment parameters by constraining the closure 12 to the closure interface 18 when the magnetic members 20, 30 of the bumper apparatus 40 are in magnetic proximity to each other.

The alignment parameters may include one or more of a clearance gap and an offset, such as the clearance gap 50 defined by adjacent edge surfaces 52, 58 or the offset 80 defined by surface 82 of closure member 16 and surface 84 of closure interface member 38. The alignment parameters may define or relate to alignment of a closure latching mechanism 66, and/or a closure mounting attachment 86, wherein misalignment and/or contact between adjacent surfaces (not shown) of the latching mechanism 66 and/or the closure attachment 86 may contribute to increased closure opening and closing efforts. The bumper apparatus 40 may enhance or maintain the appearance quality of the vehicle 10 by defining or maintaining various appearance features, such as a gap width 70 of the gap 50 and/or a door to frame flushness parameter 72 defined by the closure surface 42 and the closure interface surface 48.

The bumper apparatus 40 may be configured to provide sufficient magnetic repulsive force between the first and second magnetic members 20, 30 to prevent overslam and/or overtravel of the closure 12 during an aggressive closing event. The advantages and benefits of preventing overslam may include preventing or minimizing contact between adjacent surfaces of the closure 12 and closure interface 18, which may include minimizing contact to fascia, trim, lighting, and latching elements including a pawl, striker or D-ring, and minimizing contact to appearance surfaces including painted, coated or otherwise surface-treated surfaces and edges, thus preventing or minimizing detrimental effects of contact such as abrasion, wear, chipping, denting, coating breakdown, corrosion, squeaks, rattles, appearance misalignment, functional misalignment, increased closure opening/closing efforts, etc.

The bumper apparatus 40 is configured to constrain the closure 12 to the closure interface 18 using attractive and repulsive magnetic forces to maintain separation and alignment between the non-contacting first and second members 20, 30. The constraining force provided by the bumper apparatus 40 may be both static and dynamic. In the absence of an external force acting to misalign the closure 12 and the closure interface 18, the bumper apparatus 40 provides a static constraining force wherein the bumper apparatus 40 is at and maintains magnetic equilibrium with respect to an alignment reference 60 and a separation reference 68. In the presence of a misaligning force, e.g., when actuated by an external force input, the bumper apparatus 40 responds by providing a dynamic constraining force, e.g., the bumper apparatus 40 opposes the misaligning force with a magnetic force generated by the first and second magnetic members 20, 30 reestablishing magnetic equilibrium, thus exerting a dynamic constraining force on the closure 12 and the closure interface 18 to which the magnetic members 20, 30 are respectively attached.

The bumper apparatus 40 may be configured for initial installation on the vehicle 10 such that the bumper apparatus 40 can compensate for vehicle to vehicle build variation, including dimensional and assembly variation which may contribute to definition of the alignment parameters of the closure 12 to the closure interface 18 during vehicle assembly. The bumper apparatus 40 may be adjustable over the time the vehicle 10 is in operation, to compensate for changes in alignment of the closure 12 to closure interface 18, which may be due to wear, vibration, damage, thermal or mechanical distortion, etc. of vehicle components including attachment interfaces, and/or forces inputted to the closure system, such as closing or opening forces, road force inputs to vehicle 10 through the vehicle suspension, impact or loading forces, vibration, or other external force inputs.

The non-contact configuration of the bumper apparatus 40 provides advantages over a non-magnetic contact bumper system which depends on contact between bumpers or wedge elements positioned to contact and interfere with each other or a vehicle surface to produce a cushioning force. Non-magnetic contact bumpers may produce noise, wear, and other deterioration at the contact interface and the contacting surfaces, and/or a change in cushioning force due to wear, aging and/or distortion of the contact bumper/wedge components. By contrast, advantages of the non-contact magnetic apparatus 40 include, for example, noiseless operation, an absence of squeaks, rattles, and surface abrasion or wear due to an absence of mating or sliding surfaces in the non-contact configuration, and a cushioning force which remains consistent over time due to an absence of wearing components and the unchanging magnetic forces provided by the magnetic elements 20, 30.

Shown in FIG. 2 is a schematic top view of section 2-2 of FIG. 1 illustrating the magnetic bumper apparatus 40 in an installed position with respect to the vehicle closure 12 and closure interface 18. The closure 12 may include a first closure member 14, which may be, for example, an exterior member or panel defining an outwardly facing (with respect to the vehicle 10) surface 42 including an edge surface 52. The surface 42 and the edge portion 52 may be appearance surfaces or "Class A" surfaces, as those terms are understood within the automotive industry, such that the appearance and/or condition of these surfaces contributes to customer satisfaction with the appearance, fit and finish of the vehicle 10. The surface 42 and the edge surface 52 may be finished surfaces, e.g., polished, coated, painted or otherwise enhanced for appearance, and may incorporate trim or lighting elements. The closure 12 may include a second closure member 16, which may be, for example, an interior member or panel defining an inwardly facing (with respect to the vehicle 10) surface 82. The surface 82 may be an appearance surface or "Class A" surface, and may include one or more finished or appearance surfaces which may be polished, coated, painted, and/or otherwise enhanced for appearance, and may incorporate trim, lighting, upholstery such as leather, carpet, or other materials, etc.

The closure interface 18 may include a closure interface member 38, which may be, for example, a portion of the body of the vehicle 10 defining an opening (not shown) selectively closed by the closure 12. The closure interface member 38 may define one or more surfaces, including an outwardly facing (with respect to the vehicle 10) surface 48 including an edge portion 58, and a surface 84 which may be viewable when the closure 12 is in an open position. The surfaces 48, 84 and the edge surface 58 may be appearance surfaces or "Class A" surfaces, as those terms are understood within the automotive industry, such that the appearance and/or condition of these surfaces contributes to customer satisfaction with the appearance, fit and finish of the vehicle 10. The surfaces 48, 84 and the edge surface 58 may be finished surfaces, e.g., polished, coated, painted or otherwise enhanced for appearance, and may incorporate trim or lighting elements which define appearance surfaces.

The vehicle 10, the closure 12 and closure interface 18 are characterized by one or more alignment parameters which may affect the fit, function and/or appearance of the closure 12 with respect to the closure interface 18, when the closure 12 is in a closed position, during vehicle operation, and/or during a closing or opening event. By way of non-limiting example, the alignment parameters may include one or more of a clearance gap 50, a closure offset 80, and a flushness parameter 72, which may be defined with respect to a datum and/or relative to an axis of the vehicle 10.

The clearance gap 50 defined by the space or opening between the closure edge 52 and the closure interface edge 58 may extend the perimeter of the closure 12, and may be characterized by a gap width 70 which may vary along the perimeter of the closure 12 with respect to the closure interface 18. A minimum clearance width 70 between the edges 52, 58 may be required for closure function, to prevent contact and/or interference between the closure 12 and closure interface 18 during opening and closing events and during vehicle operation, when the vehicle 10 may be subjected to input forces, such as vibration or road input which may cause movement of the closure 12 with respect to the closure interface 18. A minimum gap width 70 may be required for fit, to allow for dimensional variability of the closure 12 or closure interface 18, assembly variability of the closure 12 to the closure interface 18 or vehicle 10 which may include variability in assembly and/or alignment of the closure attachment 86 or latching mechanism 66, to prevent contact between the closure 12 and closure interface 18. Uniformity of the width 70 of the gap 50 along at least a portion of the perimeter may be relevant to vehicle appearance and desirable for customer satisfaction.

The closure offset 80 defined by a distance between the closure 12 and the closure interface 18 in the direction of closing, e.g., along the longitudinal (front to rear) axis for the vehicle 10 shown in FIG. 2, may correspond to a closest point of interference between the closure 12 and the closure interface 18 when the closure 12 is in a closed position. A minimum closure offset 80 may be required for fit and function, to prevent contact and/or interference between the closure 12 and closure interface 18 during opening and closing events, including closing events characterized by overslam or excessive closing force, and during vehicle operation when the vehicle 10 may be subjected to input forces, such as vibration or road input which may cause movement of the closure 12 with respect to the closure interface 18. A minimum closure offset 80 may be required for appearance, to prevent contact between the closure 12 and closure interface 18 which may be abrasive, wearing or deforming contact to at least one of the closure 12, the closure interface 18, and/or surfaces 82, 84 defined thereby.

The flushness parameter 72 may be defined by the offset between an exterior surface 42 of the closure 12 and an exterior surface 48 of the closure interface 82 adjacent to the gap 50, such that when the flushness parameter 72 measures zero, the surfaces 42, 48 adjacent to the gap 50 are aligned and flush to each other. A non-zero flushness parameter 72 corresponds to the closure 12 being not flush, e.g., out of flush, with the closure interface 18. The flushness parameter 72 may be non-zero in a first direction indicating the exterior surface 42 adjacent to the gap 50 protrudes outwardly beyond the surface 48. The flushness parameter 72 may be non-zero in a second, opposite direction indicating the closure 12 is recessed within the closure interface 18 such that the exterior surface 42 adjacent to the gap 50 is recessed inwardly with respect to the surface 48. The flushness parameter 72 may extend the perimeter of the closure 12 and may vary along the perimeter of the closure 12 with respect to the closure interface 18. Flushness of the closure 12 to the closure interface 18, e.g., a flushness parameter of zero or near zero along at least a portion of the perimeter may be relevant to vehicle appearance and desirable for customer satisfaction. Flushness may be required for fit and function and may correspond to the closure offset 80. For example, an out of flush condition wherein the surface 42 is recessed inwardly may indicate or correspond to an insufficient closure offset 80, such that surfaces 82, 84 may come in contact, for example, during an overslam event. An out of flush condition wherein the surface 42 is recessed outwardly from the surface 48 may indicate a larger closure offset 80 which may correspond, for example, to reduce contact between sealing elements (not shown) provided to prevent air or water leakage into the vehicle 10 through the closure 12, contributing to air or water leakage or air noise when the closure 12 is in a closed position.

Other configurations of closure 12 and closure 18 and other arrangements and configurations of members 14, 16, 38 and surfaces 42, 52, 58, 82 and 84 are possible, and the configurations, arrangements and surface definitions shown in FIGS. 1 and 2, and the alignment parameters defined thereby are non-limiting.

The magnetic bumper apparatus 40, as shown in FIG. 2, includes a first magnetic member 20 operatively attached to the vehicle closure 12, and a second magnetic member 30 operatively attached to the vehicle closure interface 18. The positions of the first and second members 20, 30 may be reversible, e.g., the first magnetic member 20 may be operatively attached to the vehicle closure interface 18 when the second magnetic member 30 is operatively attached to the vehicle closure 12.

The magnetic bumper apparatus 40 is configured to constrain the closure 12 to the closure interface 18 using attractive and repulsive magnetic forces to establish and/or maintain alignment parameters such as the gap 50, offset 80 and flushness parameter 72 defined by the closure 12 relative to the closure 18 within the fit, function and appearance requirements of the vehicle 10 and to prevent contact between the closure 12 and closure interface 18. The terms "constrain," "constrained," "constraining," as used herein with respect to the closure 12 and closure interface 18, relate to establishing and/or maintaining the position of the closure 12 with respect to the closure interface 18 and/or a datum defined by the vehicle 10 to establish and/or maintain one or more alignment parameters using the magnetic attractive forces and magnetic repulsive forces provided by the bumper apparatus 40 when the first and second magnetic members 20, 30 are in magnetic proximity to each other. The magnetic members 20, 30 are in magnetic proximity to each other when the magnetic members 20, 30 are positioned relative to each other such that the magnetic fields defined by one of the magnetic members 20, 30 magnetically interact with the corresponding magnetic fields defined by the other of the magnetic members 20, 30, to generate at least one of an attracting or repelling force therebetween.

The first magnetic member 20 includes a magnetic portion 22 and may include a connector 26. In the example shown in FIG. 4, the magnetic portion 22 defines a first plurality 54 of spatially modulated magnetic field (SMMF) producing elements 54*a* . . . 54*e* arranged in a first pattern 24, wherein each of the SMMF producing elements 54*a* . . . 54*e* define one of a positive (North, N, or +) or negative (South, S, or −) polarity with respect to the pattern 24. The second magnetic member 30 includes a magnetic portion 32 and may include a connector 36. In the example shown in FIG. 3, the magnetic portion 32 defines a second plurality 56 of spatially modulated magnetic field (SMMF) producing elements 56*a* . . . 56*e*, wherein each of the SMMF producing elements 56*a* . . . 56*e* define one of a positive or negative polarity with respect to the pattern 34. Each of the SMMF producing elements 54*a* . . . 54*e*, 56*a* . . . 56*e* may be defined by a discrete magnet element such as neodymium-type or ferrite-type permanent magnet, and collectively assembled to form the patterns 24, 34, or may be configured by selectively depositing and magnetizing a magnetizable material on the magnetic portions 22, 32 to form the respective patterns 24, 34. Each of the SMMF producing elements 54*a* . . . 54*e*, 56*a* . . . 56*e* may include a plurality of discrete magnetic elements defining the SMMF produced by the respective SMMF producing element 54*a* . . . 54*e*, 56*a* . . . 56*e*, or may be defined by selectively depositing and magnetizing a magnetizable material to form a plurality of spatially modulated magnetic sub-fields comprising the SMMF produced by the respective SMMF producing element 54*a* . . . 54*e*, 56*a* . . . 56*e*.

Figure 3:
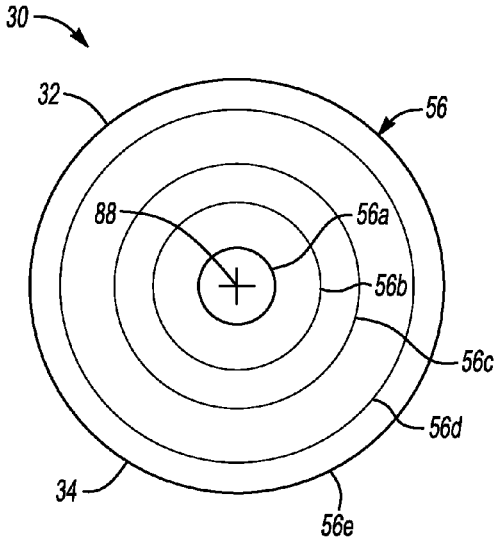
FIG. 3 is a schematic plan view of section 3-3 of FIG. 2 showing a magnetic member including a plurality of spatially modulated magnetic field (SMMF) producing elements arranged in a pattern.
Figure 4:
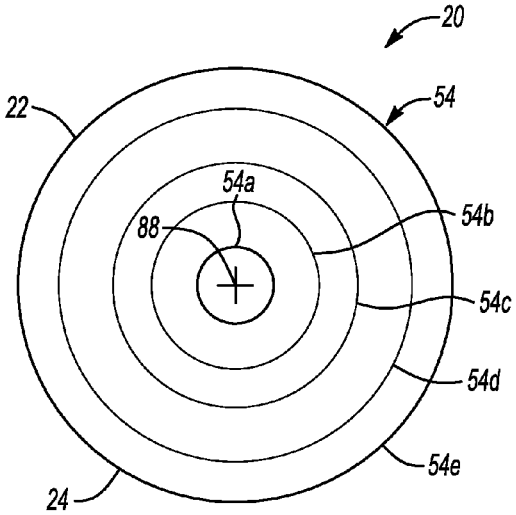
FIG. 4 is a schematic plan view of section 4-4 of FIG. 2 showing a corresponding magnetic member including a plurality of spatially modulated magnetic field (SMMF) producing elements arranged in a pattern corresponding to the pattern shown in FIG. 3.

Referring to FIGS. 3 and 4, the first and second patterns 24, 34 are arranged such that each one of the first plurality of SMMF producing elements 54 corresponds to a respective one of the second plurality of SMMF producing elements 56 to form a corresponding pair of SMMF producing elements. For example, a first SMMF producing element 54*a* from the first plurality of SMMF producing elements 54 may correspond with a first SMMF producing element 56*a* from the second plurality of SMMF producing elements 56 to form a corresponding pair of SMMF producing elements 54*a*/56*a*, a second SMMF producing element 54*b* from the first plurality of SMMF producing elements 54 may correspond with a second SMMF producing element 56*b* from the second plurality of SMMF producing elements 56 to form a corresponding pair of SMMF producing elements 54*b*/56*b*, and so on, to form a plurality of corresponding pairs of SMMF producing elements 54*a*/56*a* . . . 54*e*/56*e*, which may also be indicated herein as a plurality of corresponding pairs of SMMF producing elements 54/56, such that the first pattern 24 corresponds to the second pattern 34.

The polarities of the SMMF producing elements 54*a* . . . 54*e* and 56*a* . . . 56*e* are arranged in the corresponding patterns 24, 34 such that when the first magnetic member 20 and the second magnetic member 30 are in magnetic proximity to each other and the corresponding patterns 24, 34 are oriented to each other, a first group of one or more of the plurality of corresponding pairs of SMMF producing elements 54/56 are magnetically attractive to each other and a second group of one of the plurality of corresponding pairs of SMMF producing elements 54/56 are magnetically repulsive to each other. For example, a first group of corresponding pairs of SMMF producing elements 54*c*/56*c* and 54*e*/56*e* may be arranged with dissimilar magnetic poles (N/S or S/N) facing each other when positioned as shown in FIG. 2, such that these corresponding pairs are magnetically attractive to each other. In the same example, a second group of corresponding pairs of SMMF producing elements 54*a*/56*a*, 54*b*/56*b*, and 54*d*/56*d* may be arranged with similar magnetic poles (N/N or S/S) facing each other when arranged as shown in FIG. 2, such that these corresponding pairs are magnetically repulsive to each other. Collectively, the first group of corresponding pairs of SMMF producing elements 54/56 provides a cumulative SMMF attractive force between the first and second members 20, in magnetic proximity to each other. The strength of the SMMF attractive force may vary as the separation distance between the magnetic portions 22, 32 varies. Collectively, the second group of corresponding pairs of SMMF producing elements 54/56 provides a cumulative SMMF repulsive force defined by the plurality of corresponding pairs of SMMF. The strength of the SMMF repulsive force may vary as the separation distance between the magnetic portions 22, 32 varies.

The magnetic portions 22, 32 are configured such that when the members 20, 30 are in magnetic proximity of each other and separated by a distance greater than the equilibrium distance 78, the cumulative magnetic attractive force provided by the first group of corresponding pairs 54/56 is stronger than the cumulative magnetic repulsive force of the second group of corresponding pairs 54/56, such that the members 20, 30 are attracted to and move toward each other. When the members 20, 30 are at a separation distance equivalent to the equilibrium distance 78, the cumulative repulsive magnetic force and the cumulative attractive magnetic force are of equal strength such that the members 20, 30 are at equilibrium. At equilibrium, the members 20 are positioned relative to each other such that they are not in contact and are separated by the equilibrium distance 78, define a separation reference 68, and define an alignment reference 60. The equilibrium distance 78, separation reference 68, and alignment reference 60 are determined by the cumulative attractive magnetic force and the cumulative magnetic repulsive force, which are defined by the plurality of corresponding pairs of SMMF producing elements 54/56.

It would be understood that the first and second members 20, 30 remain positioned at equilibrium in the absence of an external force. In response to an inputted (external) force, the cumulative attractive magnetic force first and second members 20, 30 respond to the force input by exerting an opposing force to prevent movement of the first and second members 20, 30 relative to each other and away from a point of equilibrium, such that when the force input is weaker than either of the cumulative attractive or repulsive forces, the members 20, 30 will remain in an equilibrium position with respect to each other.

The first and second magnetic members 20, 30, when attached to the vehicle closure 12 and the vehicle closure interface 18 as shown in FIG. 2 such that the corresponding patterns 24, 34 are oriented and in magnetic proximity to each other, constrain the vehicle closure 12 to the vehicle closure interface 18 with respect to the separation reference 68 and the alignment reference 60. The patterns 24, 34 may be oriented to each other so as to be corresponding by positioning the magnetic members 20, relative to each other using a positioning aid (not shown), which may be a mark or indicator on the member 20, 30 used for aligning the magnetic members 20, 30 to each other during attachment to, respectively, the closure 12 and closure interface 18. In another example, each of the magnetic members 20, 30 may be attached to a respective mounting surface 62, 64, which may include an orientation feature to orient the member 20, 30 being attached. One or both of the members 20, 30 may include a connector, such as a connector 26, 36 for attachment of the member 20, 30, respectively, to the closure 12 and the closure interface 18, wherein the connector 26, 36 may include an orientation feature to orient the patterns 24, 34.

Each of the corresponding patterns 24, 34 comprising the corresponding pairs of SMMF producing elements 54/56 may be symmetrical and concentric about a central axis 88, as shown in FIGS. 3 and 4, such that orientation of one magnetic member 20, 30 to the other is simplified, for example, requiring alignment of the members 20, 30 during installation to a common axis 88 to orient the patterns 24, 34. For example, as shown in FIGS. 3 and 4, the patterns 24, 34 may arrange corresponding pairs of SMMF 54/56 in concentric rings about a common axis 88, wherein each corresponding set of concentric rings may define a repulsive force or an attractive force between the magnetic members 20, 30, and alignment of the common axis 88 of the two patterns 24, 34 orients the members 20, 30 to each other. The example of concentric patterns 24, 34 shown in FIGS. 3 and 4 is intended to be non-limiting. Other shapes of corresponding patterns, including asymmetrical corresponding patterns, may be used, and each of the corresponding patterns may include more or less the number of SMMF producing elements shown in FIGS. 3 and 4, e.g., the first pattern 24 may include n SMMF producing elements 54*a* . . . 54*n*, and the second pattern 34 may include n SMMF producing elements 56*a* . . . 56*n*, arranged in corresponding pairs 54*a*/56*a* . . . 54*n*/56*n*.

The magnetic member 20 may be adjustable in position relative to the closure 12, such that the position of the magnetic member 20 may be adjusted during installation or in service, as required to position or orient the magnetic member 20 relative to the second magnetic member 30, and/or position the magnetic member 20 relative to one or more datums defined by the vehicle 10. The magnetic member 20 may include the connector 26 configured as an attachment to the magnetic portion 22, or the connector 26 may be integrally formed with the magnetic portion 22. The connector 26 may be configured to attachably interface with a mounting surface 62 and/or attachment feature 44 defined by the closure 12. For example, the connector 26 may be configured as an adhesive to adhere the magnetic member 20 to the mounting surface 62. The adhesive may be a removable adhesive, such that the position of the magnetic member 20 may be adjusted. The connector 26 may include, by way of non-limiting example, a fastener such as a screw post or clip for attachment to an attachment feature 44, to retain the magnetic member 20 in an oriented position and/or with respect to a vehicle datum. The connector 26 and attachment feature 44 may be configured such that the position of the magnetic member 20 is adjustable laterally and/or longitudinally with respect to a datum or datums defined by the vehicle 10. The connector 26 may be configured as a holder or bracket configured to receive and/or contain the magnetic portion 22, wherein the bracket may be adjustable relative to vehicle closure 12, and/or the magnetic portion 22 may be adjustable in the bracket, to orient and/or align the magnetic member 20.

Similarly, the magnetic member 30 may be adjustable relative to the closure interface 18, such that the position of the magnetic member 30 may be adjusted during installation or in service, as required to position or orient the magnetic member 30 relative to the first magnetic member 20, and/or position the magnetic member 30 relative to one or more datums defined by the vehicle 10. The magnetic member 30 may include the connector 36 which may be configured as described for the connector 26, and may be configured to attachably interface with a mounting surface 64 and/or attachment feature 46 defined by the closure interface 18 such that the position of the magnetic member 30 is adjustable laterally and/or longitudinally with respect to a datum or datums defined by the vehicle 10.

Each of the magnetic members 20, 30 may be located relative to one or more datums defined by the vehicle, such that when the members 20, 30 cooperate to constrain the vehicle closure 12 to the vehicle closure interface 18 one or more alignment parameters are established or maintained to prevent contact between adjacent vehicle closure and vehicle closure interface surfaces. For example, the first member 20 may be positioned on the vehicle closure 12 such that the axis of the pattern 24 is located a distance 74 from a first datum defined by the edge surface 58, and the second member 30 may be positioned on the vehicle closure 18 such that the axis of the pattern 24 is located a distance 74 from the first datum 58, such that when the magnetic members 20, 30 are in magnetic equilibrium, e.g., the axis of the patterns 24, 34 are coincident and magnetically aligned, the magnetic members 20, 30 cooperate to constrain the closure 12 to the closure interface 18 to maintain the clearance gap 50 at the gap width 70 and prevent contact of the edge surfaces 52, 58.

The first member 20 may be positioned on the vehicle closure 12 and the second member 30 may be positioned on the vehicle closure 18 such that the separation reference 68 is located a distance 76 from a second datum 48, such that when the magnetic members 20, 30 are in magnetic equilibrium, e.g., the magnetic members 20, 30 are separated by the equilibrium distance 78, and the magnetic members 20, 30 cooperate to constrain the closure 12 to the closure interface 18 to maintain the offset distance 80 between the adjacent surfaces 82, 84, and to establish the flushness parameter 72. The members 20, 30 may be configured to provide a repulsive magnetic force of sufficient strength to resist a force input, such as an aggressive overslam during closing, to prevent overtravel of the closure 12 relative to the closure interface 18, and to prevent contact of the surfaces 82, 84 of the respective magnetic members as a result of the overslam.

A non-magnetic bumper element 28 may be interposed between the first and second magnetic members 20, 30. The bumper element 28 may be operatively attached to one of the magnetic members 20, 30 such that at magnetic equilibrium the bumper element 28 is not in contact with the other of the magnetic members 20, 30. The bumper element 28 may be configured of any elastic or energy absorbing material, such as a rubber-based or polymer-based material, and may be operatively attached to one of the magnetic members 20, 30 by an adhesive, clip or other attachment. In another example, the bumper element 28 may be integrated with the member 20, 30, by overmolding the bumper element 28 onto the magnetic portion 22, or configuring the bumper element 28 to be elastically conforming to and/or elastically fitted to the member 20, 30. The bumper element 28 may be configured to prevent contact between the closure surface 82 and the closure interface surface 84 during an overslam event, for example, when the first and second magnetic members 20, 30 are in magnetic non-equilibrium as a result of the overslam force and the separation distance is less the equilibrium distance 78. The bumper element 28 may prevent contact between the first and second members 20, 30, and also prevent contact between the adjacent surfaces 82, 84, while the bumper apparatus 40 responds to the overslam force by exerting a magnetic repulsive force between the first and second members 20, 30 to reestablish the equilibrium distance 78 and closure offset 80.

The magnetic members 20, 30 may be configured such that the cumulative magnetic repulsive force and the cumulative magnetic attractive force is of sufficient strength to compensate for misaligning forces which may be input to at least one of the closure 12 and the closure interface 10 during vehicle operation, such that the bumper apparatus 40 provides sufficient aligning force to constrain the closure 12 substantially at a predetermined position relative to the closure interface 18. The predetermined position may be relative to one or more datums defined by the vehicle 10. As shown in FIG. 2, the bumper apparatus 40 is configured and positioned to constrain the closure 12 by establishing the alignment reference 60 relative to a first datum defined by the edge surface 58 to maintain the clearance gap 50, and by establishing the separation reference 68 relative to a second datum defined by the closure interface surface 48 to maintain the clearance offset 80 and the flushness parameter 72.

The misaligning forces may include, for example, non-magnetic force inputs from closing and/or overslam forces, vehicle vibration, road force input, latching or closure attachment misalignment, etc. The cumulative attractive and repulsive magnetic forces provided by the bumper apparatus 40 are configured to respond to the misaligning forces to maintain the alignment parameters and the predetermined position of the closure 12 relative to the closure interface 18, preventing contact between adjacent surfaces and thereby preventing contact damage such as surface abrasion, paint chipping, etc. By constraining the closure 12 with respect to the closure interface 18 using the bumper apparatus 40, vibration and/or movement of the closure 12 relative to the closure interface may be damped, thereby reducing vehicle noise generation, including vibrations, rattling or squeaking, which may be generated by the closure system 12, 18.

More than one bumper apparatus 40 may be used to constrain the closure 12 relative to the closure interface 18. As shown in FIG. 1, a second magnetic bumper apparatus 40A may be included in the closure system 12, 18. The second magnetic bumper apparatus 40A may be configured as described herein and shown in FIG. 2, including magnetic members 20, 30 defining a plurality of corresponding pairs of SMMF producing elements 54/56 providing a cumulative magnetic repulsive force and a cumulative magnetic attractive force when the magnetic members 20, 30 are magnetically aligned and in magnetic proximity to each other. The second magnetic bumper apparatus 40A may be configured to provide the same cumulative magnetic repulsive force and/or the same cumulative magnetic attractive force as the first bumper apparatus 40, or may include different patterns of SMMF producing elements 24A, 34A (not shown) such that at least one of the cumulative magnetic repulsive force and the cumulative magnetic attractive force provided by the second bumper apparatus 40A is different from that provided by the first bumper apparatus 40. The second bumper apparatus 40A may be positioned relative to at least one of the vehicle datums used to position the first bumper apparatus 40, or may be positioned relative to at least another vehicle datum, as required to constrain the closure 12 to the closure 18 in combination with the first bumper apparatus 40. The second bumper apparatus 40A may be adjustable, such that the position of at least one of the members 20, 30 of the second bumper apparatus 40A may be adjusted during installation or over time. The first magnetic bumper apparatus 40 and the second magnetic bumper apparatus 40A may be configured to cooperatively define at least one alignment parameter of the closure 12 and the closure interface 18. The first and second bumper apparatus 40, 40A may be configured and positioned such that closing forces and/or other force inputs to the closure system 12, 18 are distributed between the first and the second bumper apparatus 40, 40A such that the clearance gaps, offsets and flushness parameters are optimized with respect to each other. The closure system 12, 18 may include a plurality of bumper apparatus 40 in various positions to cooperatively constrain the closure 12 to the closure interface 18 by responding to closing forces and/or other force inputs in a distributed manner.

A method for constraining a vehicle closure 12 relative to a vehicle closure interface 18 is provided. In one example, the method includes providing the magnetic bumper apparatus 40 configured as described herein to the vehicle 10, operatively attaching the first magnetic member 20 to one of the closure 12 and the closure interface 18, and operatively attaching the second magnetic member 30 to the other of the closure 12 and the closure interface 18. The method of operatively attaching the first and second members 20, 30 includes aligning the separation reference 68 and the alignment reference 60 of the apparatus 40 with respect to at least one datum 48, 58 defined by the vehicle 10, and constraining the closure 12 to the closure interface 18 when the first magnetic member 20 and the second magnetic member 30 are in magnetic proximity to each other to provide at least one of a clearance gap and an offset between the closure 12 and the closure interface 18. At least one of the first and second magnetic members 20, 30 may be adjustable in position with respect to one of the closure 12 and closure interface 18, such that aligning the separation reference 68 or alignment reference 60 with respect to the datum 48, 58 may include adjusting the position of at least one of the first and second magnetic members 20, 30.

The method may include resisting a force input to one of the closure 12 and the closure interface 18 by maintaining or reestablishing magnetic equilibrium between the first magnetic member 20 and the second magnetic member 30 such that contact between the closure 12 and the closure interface 18 resultant from the force is minimized, and/or the closure 12 is constrained to the closure interface 18. The method may further include engaging the bumper element 28 with the first and second magnetic members 20, 30 to prevent contact between a closure surface and a closure interface surface.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A magnetic bumper apparatus for constraining a vehicle closure to a vehicle closure interface, the magnetic bumper apparatus comprising:

a first magnetic member attached to one of a vehicle closure and a vehicle closure interface and defining a first plurality of spatially modulated magnetic field (SMMF) producing elements in a first pattern;

a second magnetic member attached to the other of the vehicle closure and the vehicle closure interface and defining a second plurality of spatially modulated magnetic field (SMMF) producing elements in a second pattern;

wherein:

the first and second patterns are arranged such that each one of the first plurality of SMMF producing elements corresponds to a respective one of the second plurality of SMMF producing elements to form a corresponding pair of SMMF producing elements, the first and second patterns defining a plurality of corresponding pairs of SMMF producing elements;

the first and second patterns are arranged such that concurrently at least one of the plurality of corresponding pairs of SMMF producing elements is magnetically attractive when at least another of the plurality of corresponding pairs of SMMF producing elements is magnetically repulsive;

the first and second magnetic members in magnetic proximity to each other generate a cumulative SMMF attractive force and a cumulative SMMF repulsive force determined by the at least one of the plurality of corresponding pairs of SMMF producing elements which is magnetically attractive in combination with the at least another of the plurality of corresponding pairs of SMMF producing elements which is magnetically repulsive;

the cumulative SMMF attractive force and the cumulative SMMF repulsive force at magnetic equilibrium define a separation reference, an alignment reference, and an equilibrium distance relative to the first and second magnetic member such that at magnetic equilibrium the first and second magnetic members are not in contact and are separated by the equilibrium distance; and the first magnetic member and the second magnetic member in magnetic proximity to each other constrain the vehicle closure to the vehicle closure interface with respect to the separation reference and the alignment reference.

2. The magnetic bumper apparatus of claim 1, wherein the first magnetic member and the second magnetic member in magnetic proximity to each other define at least one alignment parameter between a vehicle closure surface and a vehicle closure interface surface.

3. The magnetic bumper apparatus of claim 1, wherein the first magnetic member and the second magnetic member in magnetic proximity to each other prevent contact between a vehicle closure surface and a vehicle closure interface surface.

4. The magnetic bumper apparatus of claim 1, wherein the first magnetic member and the second magnetic member in magnetic proximity to each other are configured to constrain the vehicle closure to the vehicle closure interface in opposition to a non-magnetic force inputted to the vehicle.

5. The magnetic bumper apparatus of claim 1, further comprising:

a bumper element interposed between the first and second magnetic members and configured to prevent contact between a vehicle closure surface and a vehicle closure interface surface when the first and second magnetic members are in magnetic proximity and magnetic non-equilibrium.

6. The magnetic bumper apparatus of claim 5, wherein the bumper element is not in contact with one of the first and second magnetic members when the first and second magnetic members are in magnetic proximity and in magnetic equilibrium.

7. The magnetic bumper apparatus of claim 1, wherein:

the vehicle closure interface defines a first datum;

and at least one of the first magnetic member and the second magnetic member is configured for attachment to one of the vehicle closure and the vehicle closure interface such that one of the separation reference and the alignment reference is positioned with respect to the first datum.

8. The magnetic bumper apparatus of claim 7, wherein the first datum and the one of the separation reference and the alignment reference define an alignment parameter of the vehicle.

9. The magnetic bumper apparatus of claim 8, wherein the alignment parameter is one of a clearance gap and an offset between the vehicle closure and the vehicle closure interface.

10. The magnetic bumper apparatus of claim 7, wherein:

the vehicle closure interface defines a second datum;

and said at least one of the first magnetic member and the second magnetic member is configured for attachment to one of the vehicle closure and the vehicle closure interface such that one of the separation reference and the alignment reference is positioned with respect to the second datum.

11. The magnetic bumper apparatus of claim 1, wherein:

the attachment of said at least one of the first magnetic member and the second magnetic member relative to one of the vehicle closure and the vehicle closure interface is adjustable.

12. A method for constraining a vehicle closure relative to a vehicle closure interface defined by a vehicle and configured to receive the closure the method comprising:

providing a magnetic bumper apparatus including a first magnetic member and a second magnetic member, wherein:

the first magnetic member is operatively attached to the closure and defines a first plurality of spatially modulated magnetic field (SMMF) producing elements in a first pattern;

wherein the closure is movably attached to the vehicle and configured for opening and closing with respect to the closure interface;

the second magnetic member is operatively attached to the closure interface and defines a second plurality of spatially modulated magnetic field (SMMF) producing elements in a second pattern;

the first and second patterns are arranged such that:

each one of the first plurality of SMMF producing elements corresponds to a respective one of the second plurality of SMMF producing elements to form a plurality of corresponding pairs of SMMF producing elements including at least one corresponding pair of SMMF producing elements which is a magnetically repulsive corresponding pair, and at least another corresponding pair of SMMF producing elements which is a magnetically attractive corresponding pair;

the first magnetic member and the second magnetic member in magnetic proximity to each other are configured to concurrently provide a cumulative SMMF attractive force and a cumulative SMMF repulsive force;

wherein the cumulative SMMF attractive force and the cumulative SMMF repulsive force are defined by the plurality of corresponding pairs of SMMF producing elements;

the cumulative SMMF attractive force and the cumulative SMMF repulsive force at magnetic equilibrium define a separation reference, an alignment reference, and an equilibrium distance relative to the first and second magnetic member such that at magnetic equilibrium the first and second magnetic members are not in contact and are separated by the equilibrium distance;

one of the first magnetic member and the second magnetic member includes a bumper element;

operatively attaching the first magnetic member to one of the closure and the closure interface;

operatively attaching the second magnetic member to the other of the closure and the closure interface and with respect to the first magnetic member;

wherein operatively attaching the first magnetic member and the second magnetic member includes:

aligning the separation reference and the alignment reference with respect to a first datum defined by the closure interface and a second datum defined by the closure interface; and constraining the closure to the closure interface when the first magnetic member and the second magnetic member are in magnetic proximity to each other, wherein constraining the closure to the closure interface defines at least one of a clearance gap and an offset between the closure and the closure interface.

13. The method of claim 12, wherein:

at least one of the first magnetic member and the second magnetic member is an adjustable member configured to be adjustable in position with respect to one of the closure and closure interface; and aligning the separation reference and the alignment reference with respect to a first datum defined by the closure interface and a second datum defined by the closure interface includes adjusting the position of the at least one adjustable member with respect to one of the closure and closure interface.

14. The method of claim 12, further comprising:

resisting a force input to one of the closure and the closure interface by maintaining magnetic equilibrium between the first magnetic member and the second magnetic member such that contact between the closure and the closure interface resultant from the force is minimized.

15. The method of claim 14, wherein responding to the input includes:

engaging the bumper element with the first and second magnetic members to prevent contact between a closure surface and a closure interface surface.

16. A vehicle including a closure movably attached to the vehicle and configured for opening and closing with respect to a closure interface defined by the vehicle and configured to receive the closure, the vehicle further comprising:

a first magnetic bumper apparatus including a first magnetic member and a second magnetic member, wherein:

the first magnetic member is operatively attached to the closure and defines a first plurality of spatially modulated magnetic field (SMMF) producing elements in a first pattern;

the second magnetic member is operatively attached to the closure interface and defines a second plurality of spatially modulated magnetic field (SMMF) producing elements in a second pattern;

the first and second patterns are arranged such that each one of the first plurality of SMMF producing elements corresponds to a respective one of the second plurality of SMMF producing elements to form a first plurality of corresponding pairs of SMMF producing elements;

the first magnetic member and the second magnetic member in magnetic proximity to each other are configured to concurrently provide a cumulative SMMF attractive force and a cumulative SMMF repulsive force;

the cumulative SMMF attractive force and the cumulative SMMF repulsive force are defined by the first plurality of corresponding pairs of SMMF producing elements;

the cumulative SMMF attractive force and the cumulative SMMF repulsive force at magnetic equilibrium define a separation reference, an alignment reference, and an equilibrium distance relative to the first and second magnetic member such that at magnetic equilibrium the first and second magnetic members are not in contact and are separated by the equilibrium distance;

the first magnetic member and the second magnetic member in magnetic proximity to each other constrain the closure to the closure interface to define at least one of a clearance gap and an offset between the closure and the closure interface; and a non-magnetic bumper is interposed between the first and second magnetic members and configured to prevent contact between the closure and the closure interface when the first and second magnetic members are in magnetic proximity and magnetic non-equilibrium.

17. The vehicle of claim 16, wherein at least one of:

the first magnetic member is configured as an adjustable member and is adjustably attached to the closure; and the second magnetic member is configured as an adjustable member and is adjustably attached to the closure interface such that position of the adjustable member can be adjusted at least one of longitudinally and laterally relative to the vehicle to position the separation reference and the alignment reference to define at least one of the clearance gap and the offset between the closure and the closure interface.

18. The vehicle of claim 16, wherein:

the cumulative SMMF attractive force and the cumulative SMMF repulsive force are configured to respond to an input to the vehicle to prevent contact between the closure and the closure interface.

19. The vehicle of claim 16, wherein:

the closure defines a first closure surface, a second closure surface, and a closure edge;

the closure interface defines a closure interface surface and a closure interface edge;

the closure interface defines a first datum and a second datum;

at least one of the first magnetic member and the second magnetic member is positioned with respect to the vehicle to position the separation reference and the alignment reference with respect to at least one of the first datum and the second datum to define at least one of the clearance gap between the first datum and the closure edge, the offset between the second datum and the first closure surface, and the clearance gap between the closure interface surface and the second closure surface.

20. The vehicle of claim 16, further comprising:

a second magnetic bumper apparatus including a third magnetic member and a fourth magnetic member, wherein:

the third magnetic member is operatively attached to the closure and defines a third plurality of spatially modulated magnetic field (SMMF) producing elements in a third pattern;

the fourth magnetic member is operatively attached to the closure interface and defines a fourth plurality of spatially modulated magnetic field (SMMF) producing elements in a fourth pattern;

the third and fourth patterns are arranged such that each one of the third plurality of SMMF producing elements corresponds to a respective one of the fourth plurality of SMMF producing elements to form a second plurality of corresponding pairs of SMMF producing elements;

the third magnetic member and the fourth magnetic member in magnetic proximity to each other are configured to provide a cumulative SMMF attractive force and a cumulative SMMF repulsive force;

wherein the cumulative SMMF attractive force and the cumulative SMMF repulsive force are defined by the second plurality of corresponding pairs of SMMF producing elements;

the cumulative SMMF attractive force and the cumulative SMMF repulsive force define a separation reference, an alignment reference, and an equilibrium distance relative to the third and fourth magnetic member such that at magnetic equilibrium the third and fourth magnetic members are not in contact and are separated by the equilibrium distance;

the third magnetic member and the fourth magnetic member in magnetic proximity to each other constrain the closure to the closure interface; and a non-magnetic bumper interposed between the third and fourth magnetic members and configured to prevent contact between the closure and the closure interface when the third and fourth magnetic members are in magnetic proximity and magnetic non-equilibrium;

wherein:

the closure interface defines a datum;

the first magnetic bumper apparatus is operatively attached to the vehicle to define at least one of the alignment reference and the separation reference of the first magnetic bumper apparatus in a first position with respect to the datum;

the second magnetic bumper apparatus is operatively attached to the vehicle to define at least one of the alignment reference and the separation reference of the second magnetic bumper apparatus in a second position with respect to the datum; and the first magnetic bumper apparatus and the second magnetic bumper apparatus cooperate to define at least one of the clearance gap and the offset between the closure and the closure interface.

* * * * *